United States Patent [19]

Nagamoto

[11] 3,950,718

[45] Apr. 13, 1976

[54] ELECTROMAGNETIC DEVICE

[75] Inventor: Mitsuki Nagamoto, Tsu, Japan

[73] Assignee: Matsushita Electric Works, Ltd., Osaka, Japan

[22] Filed: Nov. 26, 1974

[21] Appl. No.: 527,203

[30] Foreign Application Priority Data

Nov. 30, 1973 Japan ..... 48-140019
Nov. 30, 1973 Japan ..... 48-143224[U]

[52] U.S. Cl. ..... 335/79; 335/81; 335/234
[51] Int. Cl.[2] ..... H01H 51/27
[58] Field of Search ..... 335/181, 229, 230, 234, 335/79, 81, 153

[56] References Cited

UNITED STATES PATENTS

| | | | |
|---|---|---|---|
| 2,930,945 | 3/1960 | Weathers et al. | 335/230 |
| 3,295,023 | 12/1966 | Peras | 335/153 X |
| 3,317,871 | 5/1967 | Adams | 335/230 |
| 3,486,138 | 12/1969 | Chalmers et al. | 335/153 X |
| 3,510,812 | 5/1970 | Takamura et al. | 335/153 |
| 3,585,547 | 6/1971 | Sturman | 335/230 X |

*Primary Examiner*—George Harris
*Attorney, Agent, or Firm*—Wolfe, Hubbard, Leydig, Voit & Osann, Ltd.

[57] ABSTRACT

An electromagnetic device made of flat components, which requires no resetting spring for the armature which is high in efficiency and small in size. The device comprises first and second yokes in contact respectively with magnetic pole surfaces of a permanent magnet and presenting pole faces opposed to each other. A pivoted armature, swingable between the pole faces on first and second yokes, by reason of the permanent magnetism, normally engages the pole face on the second yoke. A coil is wound around the armature, with current in the coil serving to overcome the permanent magnetism so that the armature moves to the opposite position against the pole face on the yoke. The device can be of latch type or single stable type by making the armature or either one of the yokes of a semihard magnetic material which is low in coercive force and high in residual magnetic flux density.

17 Claims, 10 Drawing Figures

ELECTROMAGNETIC DEVICE

This invention relates to electromagnetic devices and, more particularly, to an electromagnetic device effective when applied to relays.

There has been extensively used conventionally such an electromagnetic device as shown in FIG. 1 exemplarily, in which a permanent magnet 5 is fitted to a yoke 3 of an electromagnet 4 which further comprises an iron core 1 and coil 2, and a switching member 7 having a movable contact (a stationary contact opposed to the mavable contact is not illustrated) is fitted to a movable iron piece armature 6 bridged to close between the permanent magnet 5 and the iron core 1 so that, when the direction of the magnetic field of the coil 2 is made to coincide with the direction of the magnetic field by the permanent magnet 5, the armature 6 will be attracted by the iron core 1 against biasing force of a resetting spring 8 and, even when there is no more field excitation of the coil 2, the attracted state of the armature 6 will be retained by the permanent magnet 5 and, when the magnetic field of the coil 2 is made to act in the direction reverse to the magnetic field by the permanent magnet 5, the retention by the permanent magnet will be released and the armature 6 will be reset by the spring 8. However, the electromagnet of such structure has defects that the armature 6 must be attracted by the iron core 1 against the tensile force of the coil spring 8, a larger initial attracting force of the coil 2 is required and, therefore, the electric power consumed by the coil 2 has to increase, further, a strong permanent magnet 5 is required to retain magnetism, the electromagnet has to be made large in the size and, as a result, the electric power consumed by the coil 2 is further increased. The present invention has been suggested to remove these defects of the conventional devices.

The present invention has successfully achieved this purpose by forming an electromagnetic device with a permanent magnet, long and short yokes respectively overlapped at one end part of them on both ends of this permanent magnet in the magnetized direction thereof and extending at the other end part of them so as to be parallel with each other, and an armature wound with a magnetically exciting coil and disposed to reach at both ends the respective extended end parts of the long and short yokes, so that the armature will be rotatable between the end parts of the two long and short yokes.

A main object of the present invention is to provide an electromagnetic device which consumes only a small amount of electric power and can be made of small size.

Another object of the present invention is to provide an electromagnetic device of a high efficiency.

A further object of the present invention is to provide an electromagnetic device which requires no resetting spring.

Another object of the present invention is to provide an electromagnetic device which is formed substantially only by stacking respective flat component parts and is small and flat as a whole.

A further object of the present invention is to provide an electromagnetic device which can be formed to be of either a latch type or a single stable type by selecting the material of the armature or yoke.

Another object of the present invention is to provide an elctromagnetic device which is easy to apply to a relay.

A further object of the present invention is to provide an electromagnetic device which is easy and inexpensive to manufacture.

The present invention shall now be explained in detail with reference to certain preferred embodiments shown in the accompanying drawings, in which.

Figure 6A:
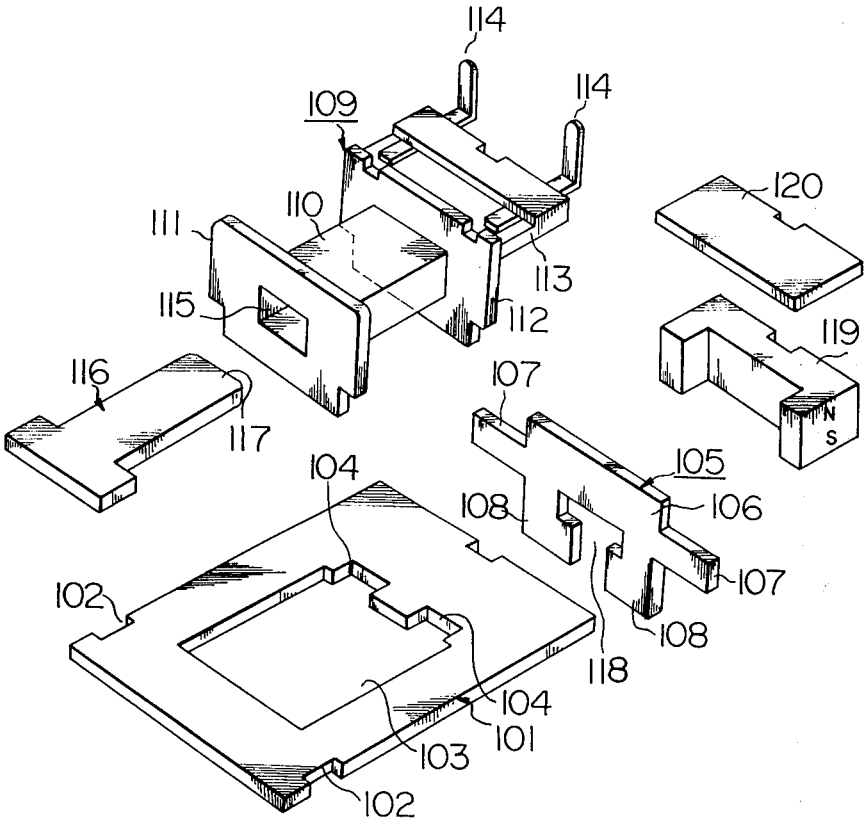
Figure 6B:
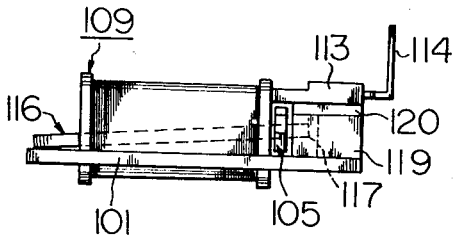
Figure 7A:
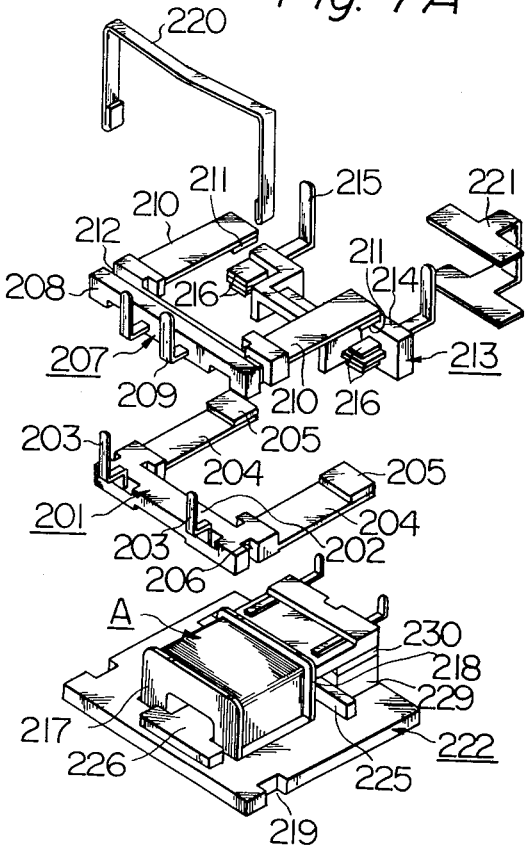
Figure 7B:
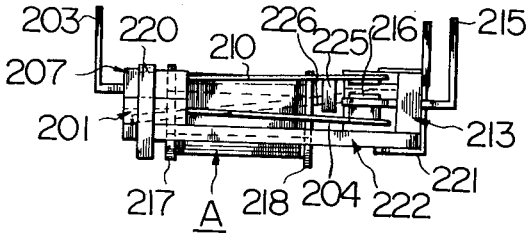

FIGS. 6A and 6B and FIGS. 7A and 7B respectively show other embodiments of the present invention, in which FIGS. 6A and 7A are perspective views as disassembled and FIGS. 6B and 7B are side views as assembled, respectively.

Figure 2:
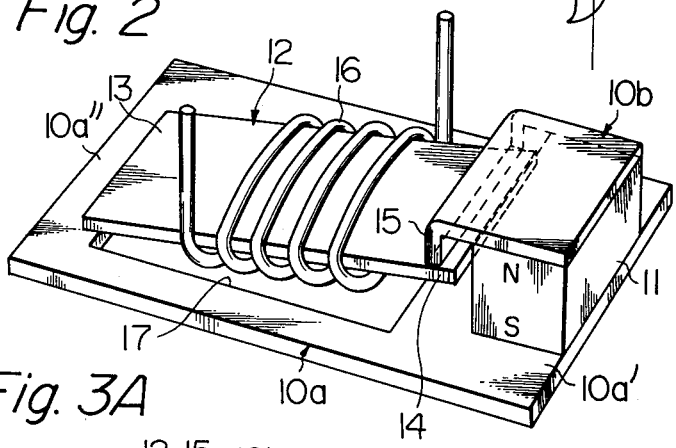
FIG. 2 is a perspective view showing an electromagnetic device according to the present invention.

Referring first to FIG. 2 showing the structure of the first embodiment of the present invention, **10*a* is a flat picture frame-shaped first yoke, at one end 10*a*' which a permanent magnet 11 magnetized to have magnetic poles N and S is mounted so that the direction between the poles will be at right angles with the plane of the first yoke 10*a*. By "picture frame-shaped" is meant a rectangular frame of flat construction having two ends and two sides and in any event at least one side. A second yoke 10*b* shorter than the first yoke 10*a* is fitted at its one end to the other end of the permanent magnet 11 so as to extend substantially parallel with the first yoke 10*a* as a whole. While in the illustrated case, one end 15 extending from the magnet 11 of the second yoke 10*b* is shown as a bent part 15 which is bent toward the first yoke, this bent part is not always necessary. A armature 12 is arranged so as to be in contact at one end 13 with the other end 10*a*'' on the side opposite the end part 10*a*' fitted with the magnet 12 of the first yoke 10*a* and at the other end with the end part 15 of the second yoke 10*b* extending substantially parallelly with the first yoke 10*a* from the magnet 11. A coil 16 is wound around the armature 12 and magnetically excited by a direct current source (not illustrated). A aperture 17 is made in the frame-shaped first yoke 10*a* so that, when the armature 12 rotates together with the coil 16 at the side of the end 14 toward the first yoke 10*a* side with the end part 13 as an axis, the coil 16** will be partly positioned within said aperture.

The operation of the electromagnetic device of the present invention shall be explained in the following with reference to FIGS. 3A and 3B.

Figure 3A:
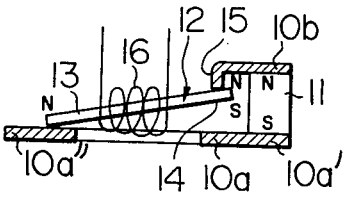
FIGS. 3A and 3B are views for explaining operational sequenses of the electromagnetic device of the present invention shown in FIG. 2.

As shown in FIG. 3A, when the permanent magnet 11 is fitted so that the second yoke **10*b* will be magnetized in the end part 15 to be N pole and the first yoke will be magnetized in the end part 10*a*'' to be S pole by the permanent magnet 11 and the armature 12 is magnetized at the free end 14 to be N pole by the excitation of the coil 16, the free end 14 will repulse the second yoke 10*b* and will be attracted by the end part 10*a*' of the first yoke 10*a*, so that the armature 12 will turn to the yoke 10*a* side and an attraction will be produced between the armature 12 and first yoke 10***a* by the magnetic fluxes by the coil 16. Therefore, if the armature 12 is provided with a switch (not illustrated), the electric circuit will be able to be switched on or off. When the excitation of the coil 16 vanishes, a magnetic circuit of the permanent magnet 11, yoke 10*b*, armature 12 and yoke 10*a* will be formed and the armature 12 will be pulled back at one end 14 toward the yoke 10*b*. When this operation is utilized, a relay of a single stable type will be able to be formed.

According to the electromagnetic device of the present invention, the armature can be turned by being magnetized with the excitation by the coil 16 and can be reset as the excitation is interrupted. Therefore, such energy to attract the armature against the force of resetting spring for the armature required in the conventional electromagnetic device is not required, so that the electric power consumed by the coil 16 is reduced, the structure of the device is made small and simple and thus an electromagnet of a high efficiency is obtained.

More particularly, according to the electromagnetic device of the present invention, when the coil is not excited, the armature will be retained as attracted by one of the two yokes due to the force of forming a closed magnetic circuit of the two yokes, armature and permanent magnet by the magnetomotive force of the permanent magnet and, on the other hand, when the coil is excited, the armature will be turned to the other yoke side by the magnetic repulsive force between the magnetomotive force produced in the armature and the magnetomotive force of the permanent magnet. Therefore, the function corresponding to that of the resetting spring for the armature in the conventional electromagnetic devices is performed by the permanent magnet in the electromagnetic device of the present invention and yet, in the case of turning the armature, the permanent magnet corresponding to this resetting spring will give a force in the direction of helping the turning movement while in the conventional devices the resetting spring will give a force in the direction reverse to it. Therefore, the electric power consumed by the coil 16 can be reduced, the structure of the device can be made small and simple and thus an electromagnetic device of a high efficiency is obtained.

Figure 1:
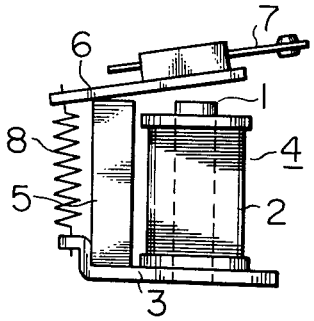
Fig. 1 (PRIOR ART)
FIG. 1 is a side view showing a conventional electromagnetic device.
Figure 4:
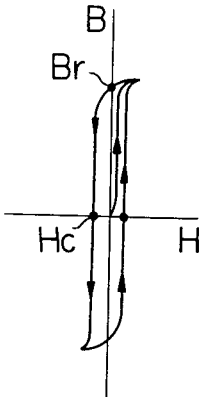
FIG. 4 is a diagram showing a B-H curve of a semi-hard magnetic material used in the present invention.

When the electromagnetic device of the present invention is formed by using such semihard magnetic material which has small magnetic retaining force, or coercive force and high residual magnetic flux density (an example of B–H characteristics of the material is shown in FIG. 4) as, for example, CS-6 produced by Sumitoms Special Metal Co., Ltd. for the armature 12 or the yoke 10*a* in the above referred embodiment, it is possible to prepare the armature or yoke with a punching work by means of a press for manufacturing the electromagnetic device of the present invention and, further, as the characteristics of the semihard magnetic material, once such armature is magnetized by flowing an electric current through the coil 16, the armature will retain the magnetism even after said current is removed so that such operation as will be described in the following can be performed.

In the state as in FIG. 3A where the permanent magnet 11 is so fitted that the second yoke 10*b* will be magnetized at the end part 15 to be N pole and the first yoke 10*a* will be magnetized to be S pole at the end part 10*a'* by the permanent magnet 11, if the armature 12 is magnetized so that the free end 14 will be S pole by the excitation of the coil 16, and free end 14 will repulse the yoke 10*a* and will be attracted by the end part 15 of the yoke 10*b*, thereby the armature 12 will turn to the side of the yoke 10*b*. Therefore, if a proper switch is coupled to such armature 12, an electric circuit connected to such switch will be controlled and, even if the coil 16 is not excited, a magnetic circuit of the permanent magnet 11, yoke 10*b*, armature 12 and yoke 10*a* will be formed and the armature 12 will remain in the state attracted by the permanent magnet.

Figure 3B:
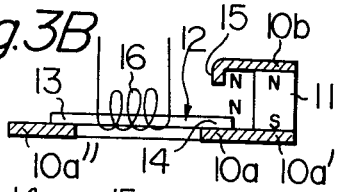

Then, in the above state, when an exciting current in the reverse direction is made to flow through the coil 16 and the armature 12 is magnetized at the free end 14 to be N pole, the free end 14 and the end part 15 of the yoke 10*b* will repulse each other and the armature 12 will turn toward the yoke 10*a* to be attracted by the yoke 10*a* as shown in FIG. 3B. Here, the residual magnetic flux density Br of the armature is so large that, even if there is no longer the excitation of the coil 16, the armature 12 will be held as attracted by the yoke 10*a* but, when the coil 16 is excited again in the reverse direction and the armature 12 is magnetized at the free end 14 to be S pole, the residual magnetic fluxes will be erased and the armature 12 will be turned to the yoke 10*b* side.

According to the magnetism retaining type electromagnetic device of the present invention, as described above, the armature 12 is magnetized directly by the coil 16 so as to have it attracted by one yoke 10*a* utilizing the residual magnetic flux density Br of the armature 12 and, on the other hand, the armature is caused to be attracted by the other yoke 10*b* by the magnetic circuit formed of the permanent magnet 11, yoke 10*b*, armature 12 and yoke 10*a*. In either cases, the armature is caused to turn only by changing the magnetizing direction of the armature. If the contact (not illustrated) is switched on or off by thus actuated armature, a so-called latch type relay will be able to be achieved.

In the above described embodiment, even if the armature 12 is formed of an ordinary magnetic material and either one of the two yokes 10*a* and 10*b* is formed of a semihard magnetic material which is small in the magnetic retaining force and large in the residual magnetic flux density, the armature will be able to be made to behave in the same manner as in the above described first embodiment, in case an exciting current is made to flow through the coil and is interrupted.

Figure 5:
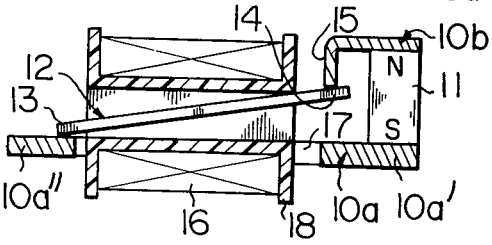
FIG. 5 is a sectioned view showing another embodiment of the present invention.

In the case of another embodiment of the present invention shown in FIG. 5, the same differs from the embodiment shown in FIG. 2 in that a coil bobbin 18 is partly contained in the aperture 17 of the yoke 10*a* and the armature 12 is provided inside said bobbin 18 so as to be free to turn. Its operation is the same as in the case of the embodiment of FIG. 2.

Referring next to another embodiment of the present invention shown in FIGS. 6A and 6B, 101 is a first yoke provided on both sides with cuts 102, in the inner part with an aperture 103 and on one side of said aperture with recesses 104. A driving piece 105 made preferably of an insulating material is in the form of substantially a reverse U-shaped body 106 having driving arms 107 laterally projecting and leg parts 108 which are slidably inserted in the respective recesses 104 of the first yoke 101. A coil bobbin 109 is provided with flanges 111 and 112 on both sides of a body 110. The flange 112 is provided with an extension 113 provided with terminal members 114. An exciting coil (not shown) is wound on the body 110 of this bobbin. The bobbin 109 is fitted by partly inserting the flanges 111 and 112, the lower parts in the drawing, into both sides of the aperture 103 of the first yoke 101. A substantially T-shaped armature 116 is inserted in a hollow part 115 within the body 110 of the bobbin 109 and also inserted at a free end 117 in a space 118 in the driving piece 105 so that the driving piece 105 will be driven with the rotation of the free end 117 of the armature. A permanent magnet 119 is fitted between the first yoke 101 and the extension 113 of the bobbin 109 together with a second yoke 120 mounted on the upper part of the magnet in the drawing. FIG. 6B shows a side view of this embodiment as assembled. Its operation is the same as of the first embodiment or the second embodiment (in which the armature or the yoke is formed of the semihard magnetic material).

FIGS. 7A and 7B show another embodiment of the present invention provided with electric contacts in the electromagnetic device shown in FIGS. 6A and 6B. In the drawings, A shows the electromagnetic device shown in FIGS. 6A and 6B, in which 207 is a first contact block having terminals 203 and movable contact springs 204 on both sides molded integrally with a body 202 made of plastics, and the terminal 203 and spring 204 are electrically connected with each other, and the spring 204 is provided with a contact at the tip. A second contact block 207 is provided having terminals 209 and movable contact springs 210 on both sides molded integrally with a body 208 made of plastics. The terminal 209 and spring 210 are also electrically connected with each other, and the spring 210 is provided with a contact 211 at the tip. A third contact block 213 having terminals 215 and fixed contacts 216 is molded integrally with a body 214 made of plastic. The terminal 215 and fixed contact 216 are electrically connected with each other.

In assembling them, the first contact block 201 and second contact block 207 are stacked, in the order memtioned, on the flange 217 side on the second yoke of the electromagnet A, the third contact block 213 is mounted on the flange 218 side, a band 220 is engaged with grooves 212 of the second contact block 207, grooves 206 of the first contact block 201 and grooves 219 of the second yoke 222, respectively, and the upper surface of the body 214 of the third contact block 213 and the lower surface of the second yoke 222 are held with a pressing spring 221 to fix them. The operation is the same as of the respective embodiments described in the foregoing.

According to the embodiments of FIGS. 6A and 6B and FIGS. 7A and 7B, the assembling is so easy and the dimensional precision of each unit is so easy to attain that the entire dimensional precision can be easily elevated.

While in the foregoing descriptions specifically with references to the embodiments shown in FIGS. 2 through 5 there has not been specified, it should be appreciated that the movable core or armature 12 is to be arranged so as to be held in the position referred to and shown and not to be moved in its londitudinal direction as attracted by the permanent magnet. For this purpose, the armature 116 or 226 in the embodiment of FIG. 6 or 7 has been shown as formed in substantially a T-shaped plate member, so that the end having lateral extensions and remain outside the coil bobbin at the side remote from the permanent magnet will be held locked by an end surface of the coil bobbin while the end will be movable with respect to the first yoke 101 or 222.

Further in connection with the above, specifically with reference to FIGS. 2 through 5, the end 14 of the armature 12 has been referred to simply as to be a free end. This means that the other end 13 referred to as engaged with the end 10*a*'' of the first yoke 10*a* as attracted by the particular yoke is to be always a stationary end which acts as a pivot of the armature 12 rotatable depending on the exciting current or currents through the coil 16. It should be here noted the reason why the end 13 of the armature 12 is stationary always without being repulsed away from the first yoke end 10*a*'' even in the sequence shown in FIG. 3B. In the particular sequence shown in the drawing, the armature end 13 is magnetized to be of S pole which is to be generally repulsed by the first yoke 10*a* magnetized in S polarity by the magnet 11. However, the first yoke end 10*a*'' is far remote from the magnet 11 than the part of the yoke to which the armature end 14 is attracted and, consequently, the magnetic flux density around the yoke end 10*a*'' with which the armature end 13 engages is much lower than that around the yoke end 10*a*' and armature end 14. For this reason, the magnetic attraction force to which the armature end 14 is subjected is much stronger than the repulsing force between the armature end 13 and the yoke end 10*a*'' so that the armature 12 will remain as engaged with the first yoke at the ends 13 and 14 as shown. This phenomenon applies to both cases where the both yokes and armature are made of ordinary magnetic material and where any one of them is made of the semihard magnetic material referred to.

For achieving the above phenomenon, it is thus preferable that the permanent magnet is positioned adjacent one end of the respective first and second yokes or, more particularly, the second yoke in the instances as shown is made to be of a shorter length than the first yoke.

What is claimed is:

1. An electromagnetic device comprising a permanent magnet, first and second yokes in contact respectively at one end with each of the magnetic pole surfaces of said permanent magnet and extending opposed to one another in parallel spaced relation, the first yoke being longer than the second and terminating in a base end, a swingable armature pivoted at the base end of the first yoke and disposed between said first and second yokes and spaced from said permanent magnet so as to be alternatively engageable with respective opposing surfaces of the first and second yokes, and a coil wound around said armature and arranged so as to allow said armature to swing between the yokes.

2. The electromagnetic device according to claim 1 wherein at least one of said first and second yokes and armature is formed of a semihard magnetic material which is small in the magnetic retaining force and large in the residual magnetic flux density.

3. An electromagnetic device comprising a permanent magnet, first and second yokes in contact respectively with each of the magnetic pole surfaces of said permanent magnet and arranged in opposition to each other, a swingable armature disposed between said first and second yokes and spaced from said permanent magnet so as to be alternatively engageable with respective opposing surfaces of the first and second yokes, and a coil wound around said armature and arranged so as to allow said armature to swing between the yokes, said armature being formed of a semihard magnetic material which is small in coercive force and large in residual magnetic flux density, said coil being wound on a bobbin, said first yoke having an aperture in the part facing said bobbin so that the part of said bobbin facing the first yoke is contained in said aperture, and said armature being inserted through axial space in said bobbin.

4. An electromagnetic device comprising a permanent magnet, first and second yokes in contact respectively with each of the magnetic pole surfaces of said permanent magnet and arranged in opposition to each other, a swingable armature disposed between said first and second yokes and spaced from said permanent magnet so as to be alternatively engageable with respective opposing surfaces of the first and second yokes, and a coil wound around said armature and arranged so as to allow said armature to swing between the yokes, at least one of said first and second yokes being formed of a semihard magnetic material which is small in coercive force and large in residual magnetic flux density, said coil being wound on a bobbin, said first yoke having an aperture in the part facing said bobbin so that the part of said bobbin facing the first yoke is contained in said aperture, and said armature being inserted through axial space in said bobbin.

5. An electromagnetic device comprising a permanent magnet, first and second yokes in contact respectively with each of the magnetic pole surfaces of said permanent magnet and arranged in opposition to each other, a swingable armature disposed between said first and second yokes and spaced from said permanent magnet so as to be alternatively engageable with respective opposing surfaces of the first and second yokes, and a bobbin therefore a coil wound around said armature and arranged so as to allow said armature to swing between the yokes, at least one of said first and second yokes being provided with an aperture at a section opposing said bobbin for allowing the bobbin and coil thereon to partly rest therein.

6. An electromagnetic device comprising a first yoke of a substantially rectangular plate, a permanent magnet stacked on one end section of the first yoke so that its axis in the magnetized direction will be vertical to the plane of the first yoke, second yoke stacked at an end thereof on said permanent magnet so as to extend from the magnet as opposed to said first yoke, a coil bobbin having an exciting coil wound on axial body thereof and an axially extending space, said bobbin being stacked substantially between the first and second yokes so that said axial space will be substantially in parallel relation to the yokes as spaced from the permanent magnet providing a magnetic gap, and a movable core inserted through said axial space in the bobbin so as to extend at an end into said magnetic gap as spaced from the permanent and normally attracted at said end by the second yoke while engaged as attracted at the other end with the first yoke, so that, when an exciting current is flown to the coil to magnetize said end of the core in the magnetic gap to be of the same polarity as that of the second yoke, the movable core will be rotated so as to be attracted by the first yoke.

7. The electromagnetic device of claim 6 wherein said first and second yokes and movable core are made of a magnetic material, so that when said exciting current is interrupted, the movable core will return to its original position as attracted by the second yoke.

8. The electromagnetic device of claim 6 wherein at least one of said first and second yokes and movable core is made of a semihard magnetic material having a small magnetic retaining force and a large residual magnetic flux density, so that when said exciting current is interrupted the movable core will remain as attracted by the first yoke and when another exciting current is flown to the coil to magnetize the end of the core in the magnetic gap to be of an opposite polarity to that of the second yoke the movable core will rotate to the second yoke side.

9. The electromagnetic device of claim 6 wherein said first yoke is provided with an aperture longitudinally offset providing a longer end section and a shorter end section, said permanent magnet being stacked on the end of the first yoke at the side of said longer end section, said second yoke is of a length substantially coinciding with said longer end section of the first yoke, and said coil bobbin is partly rested in said aperture of the first yoke at the side facing the first yoke.

10. The electromagnetic device of claim 9 wherein said movable core is of a substantially T-shaped plate inserted through said axial space of the bobbin so that an end of longitudinal leg part of the T-shape will extend into said magnetic gap and lateral extensions at the other end of the T-shape will engage an end surface of the bobbin at the side remote from the permanent magnet so as to prevent the movable core from being attracted to the permanent magnet.

11. The electromagnetic device of claim 9 wherein said movable core is provided with a means for transmitting the rotation of the core to the exterior of the device and mounted adjacent said end of the core extended into the magnetic gap so as to be movable together with the core, said means having at least an arm which is accessible from the exterior.

12. The electromagnetic device of claim 6 which further comprises in combination a drive means mounted adjacent said end of the movable core extended into said magnetic gap so as to be movable together with the core and having at least an arm extended out of the magnetic gap, a movable contact block stacked on said first yoke at the end side thereof where said the other end of the core engages with the first yoke, said movable contact block including at least a movable contact spring extending aside said coil bobbin substantially to the other end of the first yoke and at least a terminal member electrically connected with said movable contact spring, said movable contact spring having a movable contact secured at extended end of the spring and being engaged with said arm of the drive means so as to be driven by the means upon rotation of the movable core, and a stationary contact block stacked on the other end side of the first yoke opposite said movable contact block, said stationary contact block including at least a stationary contact opposing said movable contact and at least a terminal member electrically connected with said stationary contact.

13. In an electromagnetic relay construction, the combination comprising first and second yokes of magnetic material, the first yoke being of flat picture frame shape having a large central opening bounded by a base end and a head end, the head end forming a main pole face, a pivoted armature spanning the central opening and having a pivot connection with the base end and swingable toward and away from the main pole face at the head end, a permanent magnet of generally rectangular shape seated on the head end, a second yoke substantially shorter than the first yoke seated on the permanent magnet and presenting an alternate pole face which overlies the main pole face and which is of opposite polarity, the armature being normally attracted to the alternate pole face by flux from the permanent magnet, and a relay coil surrounding the armature and dimensioned to project into the opening so that when a current passes through the coil, setting up magnetic flux in the armature in a direction opposite to the flux induced by the permanent magnet, the armature will move from the alternate pole face to the main pole face.

14. The combination as claimed in claim 13 in which the yokes and armature are made of magnetic material having a low residual flux density so that when the current is shut off the armature will return to its initial position adjacent the alternate pole face.

15. The combination as claimed in claim 13 in which at least one of the first yoke, second yoke, and armature is made of retentive magnetic material having a low coercive force but a high residual flux density so that when the current is shut off the armature will remain latched in position against the main pole face and so that current flow must be applied in the opposite direction to restore the armature to its normal position adjacent the alternate pole face.

16. The combination as claimed in claim 13, in which the pivot connection between the armature and the base end of the first yoke is magnetically maintained in engagement.

17. The device according to claim 1 wherein said first yoke and armature are of flat construction and wherein the said first yoke has a large central opening for registered reception of said coil permitting the armature, in one of its positions, to lie flatly against said first yoke.

* * * * *